US006817325B2

(12) United States Patent
Dinkel et al.

(10) Patent No.: US 6,817,325 B2
(45) Date of Patent: Nov. 16, 2004

(54) HYDRAULIC MANIFOLD ASSEMBLY FOR VARIABLE ACTIVATION AND DEACTIVATION OF VALVES IN AN INTERNAL COMBUSTION ENGINE

(75) Inventors: Mike J. Dinkel, Rochester, NY (US); Dave Beiswenger, Fischers Landing, NY (US); Doug Gnage, Dunkirk, MD (US); Michael Brosseau, Rochester, NY (US); Daniel F. Smith, Conesus, NY (US)

(73) Assignee: Delphi Technologies, Inc., Troy, MI (US)

( * ) Notice: Subject to any disclaimer, the term of this patent is extended or adjusted under 35 U.S.C. 154(b) by 128 days.

(21) Appl. No.: 10/007,714

(22) Filed: Nov. 13, 2001

(65) Prior Publication Data

US 2003/0089322 A1 May 15, 2003

(51) Int. Cl.[7] ..... F01L 9/02

(52) U.S. Cl. ..... 123/90.13; 123/90.12; 123/90.15

(58) Field of Search ..... 29/890.052, 890.03, 29/525; 123/90.13, 90.14, 90.15, 90.16, 90.17

(56) References Cited

U.S. PATENT DOCUMENTS 5,242,016 A * 9/1993 Voss et al. ..... 165/174
5,528,272 A * 6/1996 Quinn et al. ..... 347/42
5,575,249 A * 11/1996 Mielke et al. ..... 123/184.57
5,819,776 A * 10/1998 Kephart ..... 137/1
5,846,493 A * 12/1998 Bankier et al. ..... 422/101
5,855,229 A * 1/1999 Gluf, Jr. ..... 137/884
6,068,370 A * 5/2000 Miller et al. ..... 347/85

* cited by examiner

*Primary Examiner*—Thomas Denion
*Assistant Examiner*—Jaime Corrigan
(74) *Attorney, Agent, or Firm*—Patrick M. Griffin

(57) ABSTRACT

A hydraulic manifold assembly for variable actuation of engine valves. First and second plates have portions of flow passages integrally molded therein. The plates are formed preferably by injection molding of a suitable polymer, for example, glass-filled nylon, and are joined together as by cementing or preferably by fusion welding (vibration welding) along mating surfaces to form the full pattern of flow passages. This method of forming the manifold obviates the need for separate fasteners to connect the plates and for internal seals to form the flow passages. The assembly further comprises a retainer for retaining a plurality of individual solenoid-actuated valves in sockets formed in the plates. Preferably, the retainer is formed to function simultaneously as a positive crankcase ventilation (PCV) baffle that attaches to the plates via integrally molded releasable snap tabs. The present manifold results in a weight savings and a substantial savings in manufacturing cost over a prior art manifold formed of cast aluminum.

18 Claims, 9 Drawing Sheets

HYDRAULIC MANIFOLD ASSEMBLY FOR VARIABLE ACTIVATION AND DEACTIVATION OF VALVES IN AN INTERNAL COMBUSTION ENGINE

TECHNICAL FIELD

The present invention relates to internal combustion engines; more particularly, to devices for controlling systems in an internal combustion engine; and most particularly, to an improved hydraulic manifold assembly for controlling the flow of engine oil in variable activation and deactivation of valve lifters in an internal combustion engine.

BACKGROUND OF THE INVENTION

In conventional prior art four-stroke internal combustion engines, the mutual angular relationships of the crankshaft, camshaft, and valves are mechanically fixed; that is, the valves are opened and closed fully and identically with every two revolutions of the crankshaft, fuel/air mixture is drawn into each cylinder in a predetermined sequence, ignited by the sparking plug, and the burned residue discharged. This sequence occurs irrespective of the rotational speed of the engine or the load being placed on the engine at any given time.

It is known that for much of the operating life of a multiple-cylinder engine, the load might be met by a functionally smaller engine having fewer firing cylinders, and that at low-demand times fuel efficiency could be improved if one or more cylinders of a larger engine could be withdrawn from firing service. It is known in the art to accomplish this by de-activating the valve train leading to preselected cylinders in any of various ways, such as by providing special valve lifters having internal locks which may be switched on and off either electrically or hydraulically. Such switching is conveniently performed via a hydraulic manifold that utilizes electric solenoid valves to selectively pass engine oil to the lifters upon command from an engine control module (ECM). Such a manifold is referred to in the art as a Lifter Oil Manifold Assembly (LOMA).

It is a principal object of the present invention to provide an improved solenoid-actuated hydraulic manifold assembly for controlling the hydraulic locking and unlocking of deactivatable valve lifters in an internal combustion engine, wherein at least a portion, and preferably all, of the manifold components are formed by injection molding of a polymer.

It is a further object of the invention to provide such a manifold assembly wherein any trapped air is automatically purged immediately upon engine startup and is prevented from re-entry during engine operation.

It is a still further object of the invention to provide such an assembly comprising a minimum number of components which then may be easily fabricated, and preferably which are formed of a suitable thermoplastic polymer such that the components may be fusibly joined without threaded fasteners as by vibration welding.

SUMMARY OF THE INVENTION

Briefly described, a hydraulic manifold assembly for variable actuation of engine valves in accordance with the invention includes first (top) and second (bottom) plates having portions of oil flow passages, or galleries, integrally molded therein. The plates are formed preferably by injection molding of a suitable high temperature thermoplastic polymer. The plates are joined together as by cementing or preferably by fusion welding (vibration welding) along mating surfaces, obviating the need for separate fasteners and for internal seals on the flow passages. The assembly further comprises a retainer for retaining a plurality of individual solenoid-actuated valves in operational disposition in sockets formed in the plates. Preferably, the retainer is formed with air passageways so as to function simultaneously as a positive crankcase ventilation (PCV) baffle that attaches to the plates via integrally molded releasable snap clips. The present hydraulic manifold results in a weight savings and a substantial savings in manufacturing cost over prior art manifolds formed of cast aluminum.

BRIEF DESCRIPTION OF THE DRAWINGS

These and other features and advantages of the invention will be more fully understood and appreciated from the following description of certain exemplary embodiments of the invention taken together with the accompanying drawings, in which.

DESCRIPTION OF THE PREFERRED EMBODIMENTS

Figure 1:
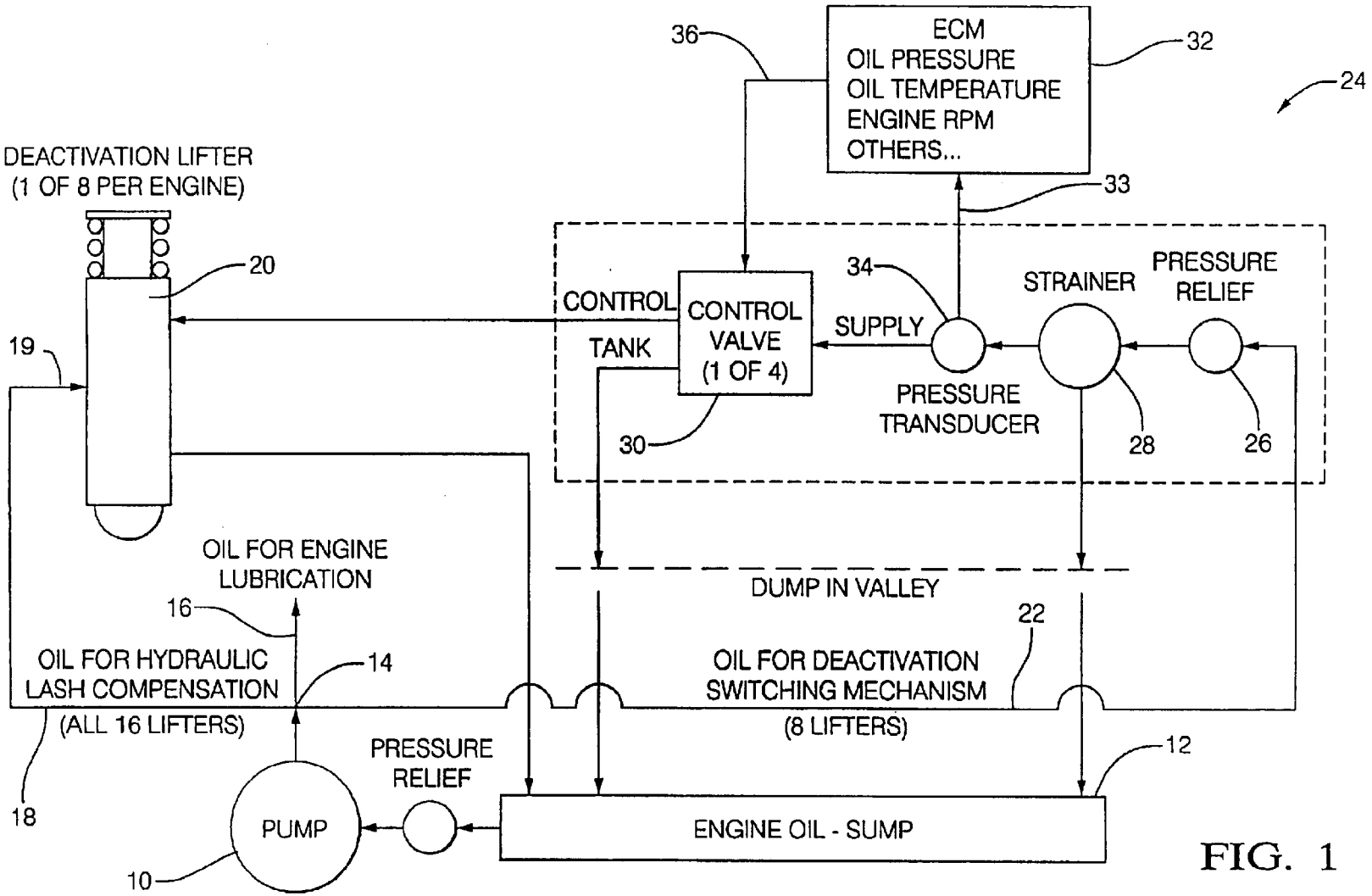
FIG. 1 is a schematic drawing of an oil system for an internal combustion engine showing the relationship of a valve deactivation control system in accordance with the invention to a prior art pressurized oil system.

Referring to FIG. 1, the engine oil circuits for an internal combustion engine are provided with a valve deactivation control circuit in accordance with the invention. While only a single control valve and lifter are shown in the schematic drawing, it should be understood that valve deactivation is useful only in multiple-cylinder engines for selectively reducing the number of combusting cylinders. Multiple-cylinder embodiments are discussed below. In FIG. 1, an oil pump 10 feeds oil from sump 12 to a juncture 14 where the flow is split three ways. A first portion 16 provides conventional general lubrication to the engine. A second portion 18 provides oil conventionally to the hydraulic valve lash adjusters 19, which support valve deactivation lifters 20. A third portion 22 provides oil to a valve deactivation control system 24. An optional pressure relief valve 26 is openable to the sump to maintain pressure in system 24 at a predetermined maximum level. Oil is filtered by strainer 28 and then is supplied to a solenoid control valve 30 wherein it is either diverted to the sump 12 if the control valve 30 is not energized, or is diverted to deactivation lifter 20 if the control valve 30 is energized, to cause the associated engine intake and exhaust valves to be deactivated. An engine control module (ECM) 32, preferably mounted on other than the engine, receives input signals 33 from a pressure transducer 34 in the control system 24 and integrates via an algorithm such signals with other input operating data such as oil temperature and engine speed to provide output signals 36 to energize or de-energize solenoid control valve 30.

Figure 2:
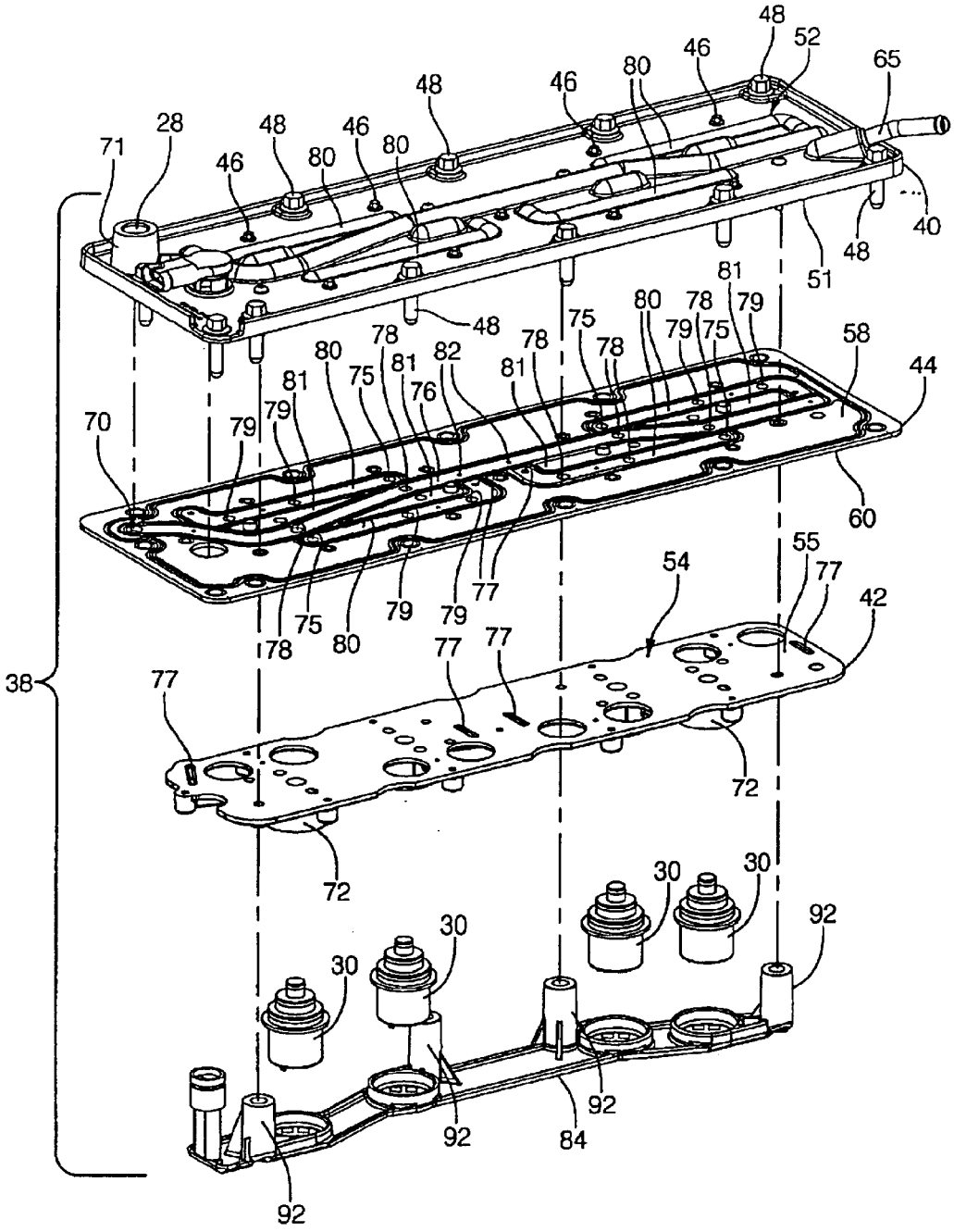
PRIOR ART FIG. 2
FIG. 2 is an exploded isometric view from above of a prior art hydraulic manifold assembly.

The benefits and advantages of an improved hydraulic deactivation control manifold in accordance with the invention may be best appreciated by first considering a prior art hydraulic manifold. Referring to FIG. 2, a prior art valve deactivation control manifold 38 includes a top plate 40, a bottom plate 42, and a gasket plate 44 sandwiched between the top and bottom plates. Typically, at least the top and bottom plates are formed by investment casting of aluminum. The three plates are held together by bolts 46 to form a complex oil distribution manifold 38 as described below. When assembled, manifold 38 may be conveniently installed into an internal combustion engine, for example, via bolts 48 extending through bores in top plate 40 and gasket plate 44 and being secured, for example, onto engine block towers provided along opposite sides of the valley of a V-style engine (not shown) for operative control of the deactivation lifters of the engine.

A first pattern of passages (not visible) is formed in the underside 51 of top plate 40, which may be expressed as a corresponding pattern of ridges 52 on the upper surface thereof. Similarly, a second pattern of passages 54 is formed in the upper surface 55 of bottom plate 42. Gasket plate 44 is provided with a plurality of bores extending completely through the plate at selected locations for connecting passages in top plate 40 with passages in bottom plate 42. The upper surface 58 and the lower surface 60 of gasket plate 44 are further provided with respective patterns of resilient gasketing material generally in the shape of the patterns of passages and bores in the top and bottom plates. Typically, the gasketing patterns are disposed in shallow grooves in surfaces 58, 60 into which the gasketing material may be fully compressed when manifold 38 is assembled.

The oil passages and gasketing patterns in plates 40,42,44 cooperate to define and form the oil galleries of a complex three dimensional hydraulic manifold 38 for selectively distributing pressurized oil from an oil riser 70 to each of four solenoid control valves 30 received in sockets 72 formed in bottom plate 42. Control valves 30 extend through bottom plate 42 and the valve heads thereof seal against seats (not shown) on the underside of gasket plate 44. Each of the control valves 30 controls the activation and deactivation of all valve lifters for a given cylinder of a multi-cylinder engine via outlet ports (not visible) in manifold 38; thus, four control valves are required, for example, to deactivate valves for four cylinders of an eight-cylinder engine.

Oil is distributed along the manifold from riser 70 via a global supply gallery 76 which connects via bores 78 in gasket plate 44 to control valves 30. Riser 70 may be provided with an inline strainer housing 71 for ready replacement of strainer 28. When a valve 30 is energized to open, oil is admitted past solenoid valve 30 and upwards through plate 44 via bore 75 into an individual supply gallery 80 for supplying two deactivation valve lifters via bores 79. It is highly important for proper and reliable engine response that galleries 80 be entirely free of air when valves 30 are called upon to provide pressure to their respective deactivation lifters. During periods of engine shutdown, the galleries in manifold 38 tend to drain by gravity to sump 12 via bore 75 which is then connected to a drain port through valve 30, the oil being replaced by air. It is highly undesirable to purge such air through the lifters upon startup; therefore, a fill path is provided for each of galleries 80. Bypass ports 82 are provided through gasket plate 44 in global supply gallery 76 leading via bypass orifices 77 into each of the individual galleries 80 to fill galleries 80 and the lines leading to the deactivation lifters (not shown). Oil is continually flowed, when control valve 30 is de-energized, through a passage in valve 30 into return gallery 81. This arrangement keeps gallery 80 filled with oil and thus prevents entry of air into the supply lines leading from the control valves to the deactivation lifters.

A retainer 84 holds the solenoid control valves 30 in their respective sockets 72. Connector/retainer 84 is typically cast of a high-temperature dielectric plastic and is provided with integral standoffs 92 through which it is bolted into top plate 40.

Figure 3:
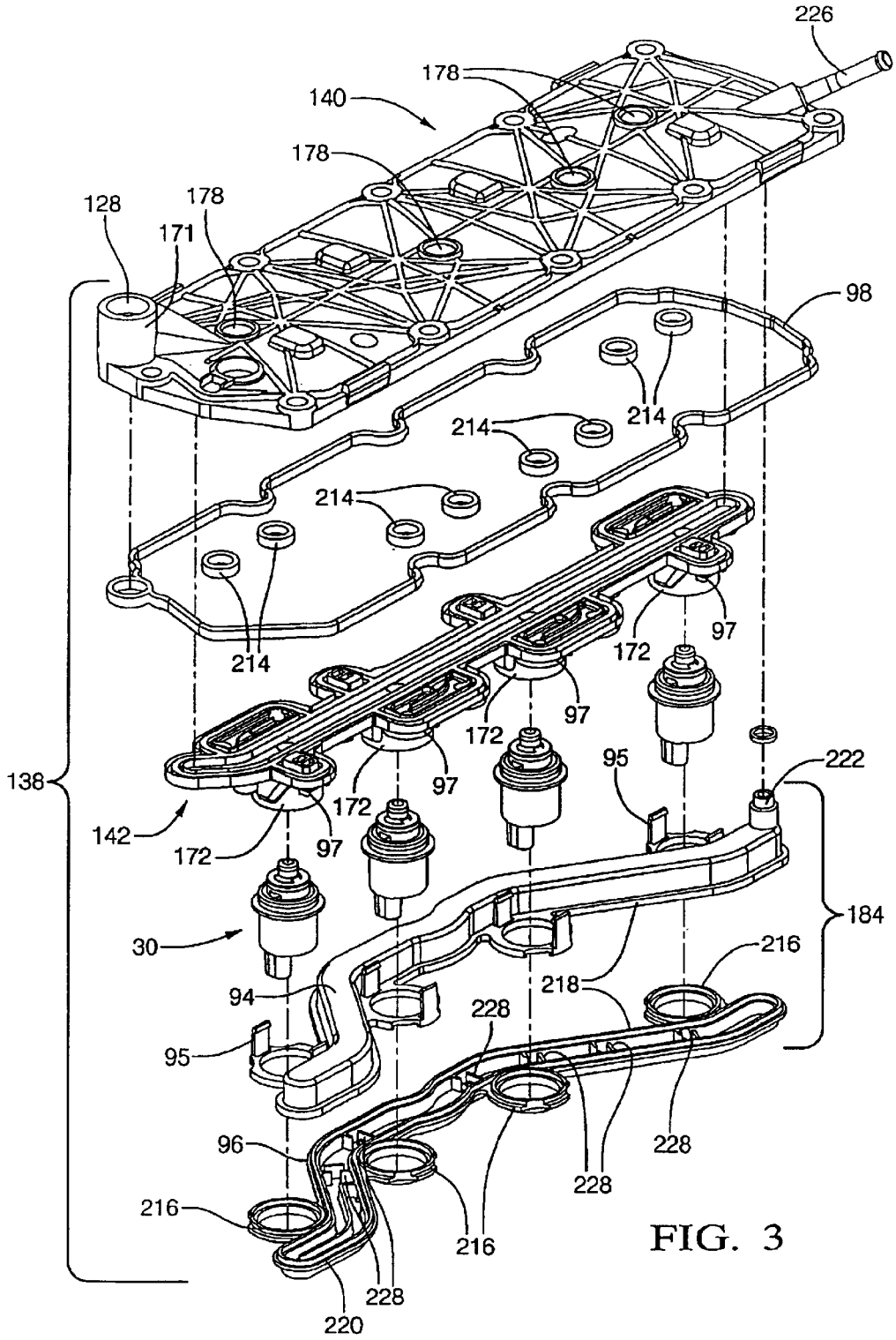
FIG. 3 is an exploded isometric view from above of a hydraulic manifold assembly in accordance with the invention.
Figure 4:
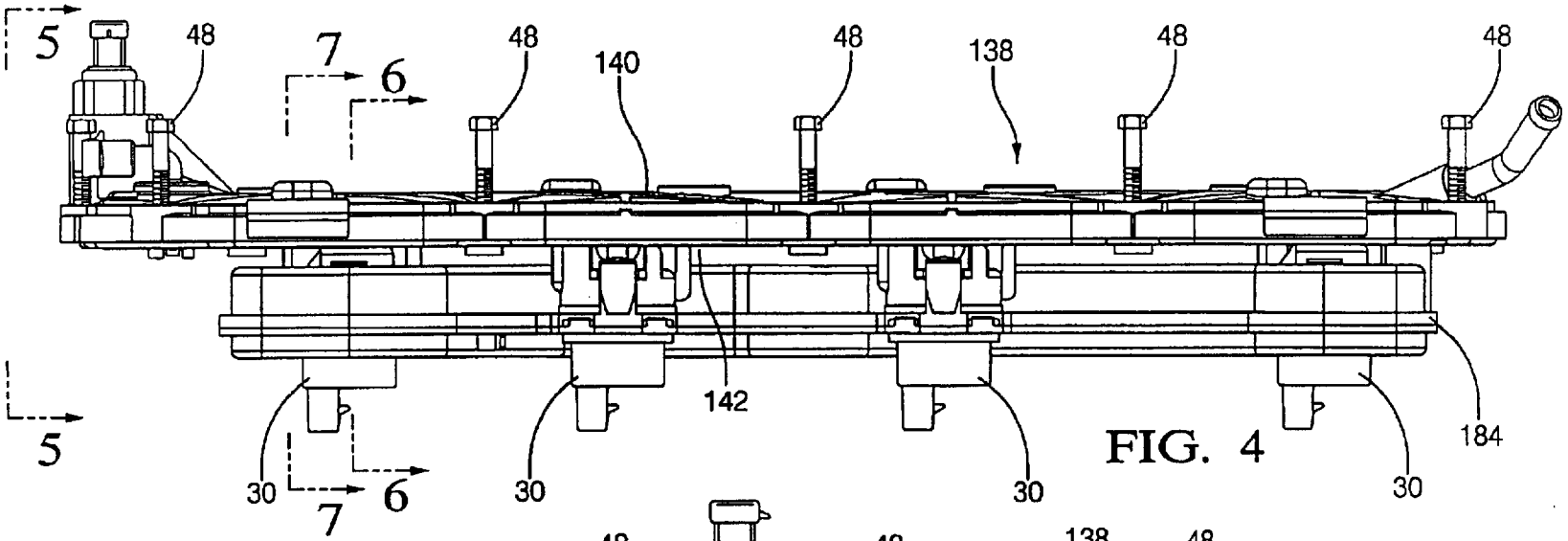
FIG. 4 is a side elevational view of the hydraulic manifold assembly shown in FIG. 3.
Figure 5:
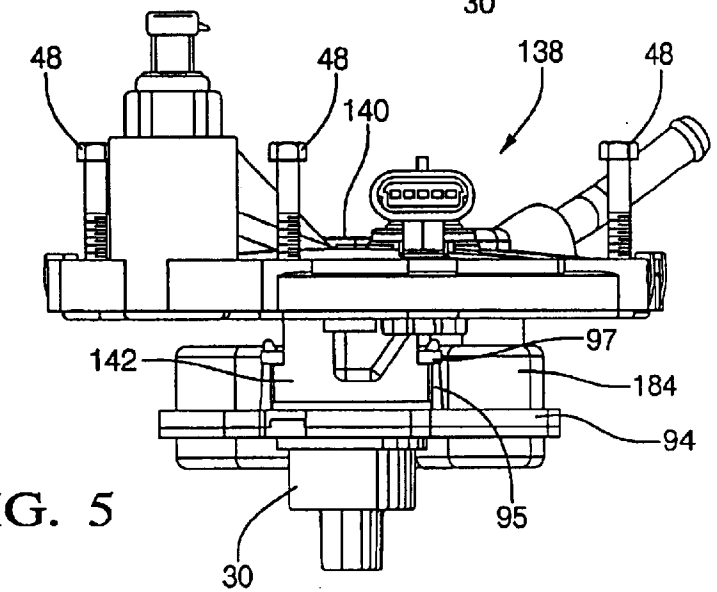
FIG. 5 is an end elevational view of the hydraulic manifold assembly taken along 5—5 in FIG. 4.

Referring to FIGS. 3 through 5, an improved LOMA 138 is shown. (Note: features identical with those in prior art LOMA 38 carry the same numbers; features analogous but not identical carry the same numbers but in the 100 series; and new features are shown in the 200 series.) LOMA 138 includes a top plate 140, bottom plate 142, solenoid valves 30, and retainer 184. Retainer 184, which preferably also is a positive crankcase ventilation (PCV) baffle as described in more detail below, may conveniently be formed in an upper element 94 and a lower element 96 which are then joined along their mating edges as described below to form retainer 184. Preferably, retainer 184 is formed having flexible barbed tabs 95 protruding upwards from upper element 94 for engaging with mating catches 97 to secure retainer 184 to bottom plate 142, thereby retaining solenoid valves 30 in proper position in sockets 172. A perimeter gasket 98 is preferably used to seal top plate 140 against an engine (not shown) when assembly 138 is attached by bolts 48 onto the valley of a V-style engine.

Figure 11:
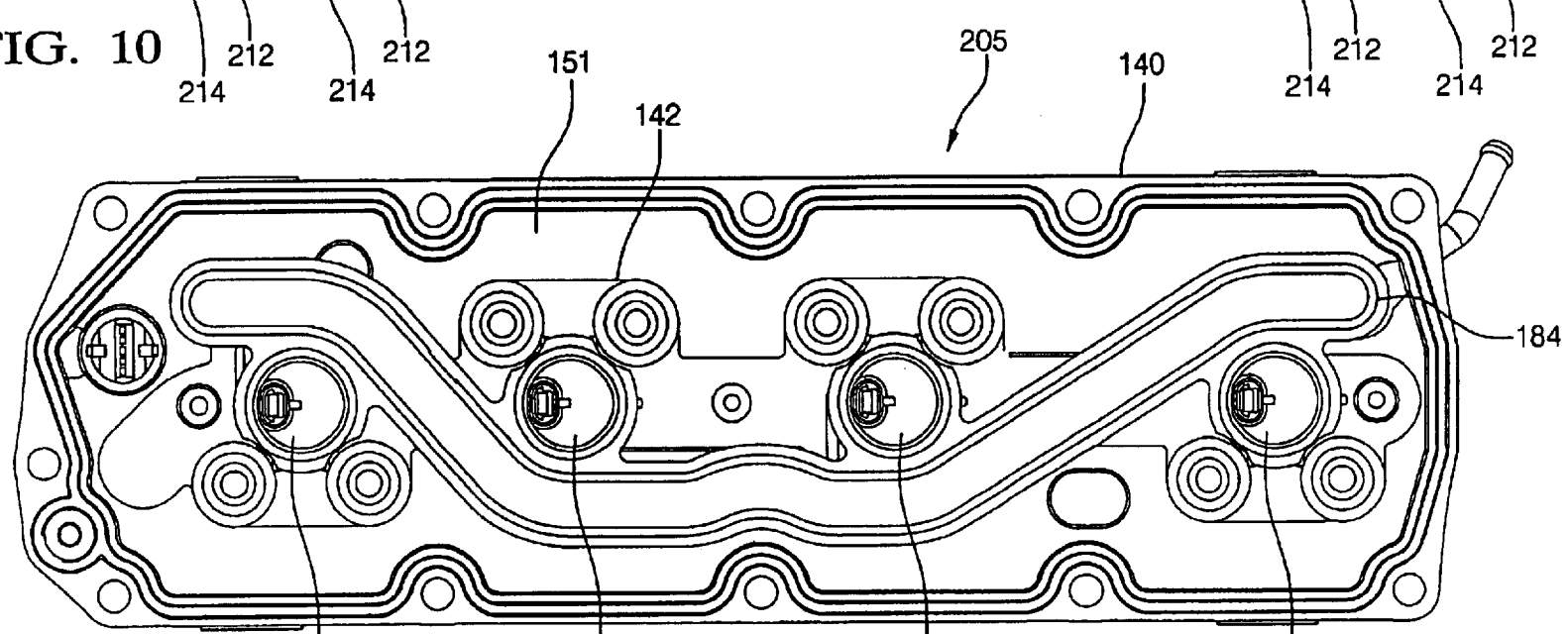
FIG. 11 is a bottom view of the assembly shown in FIG. 4.
Figure 12:
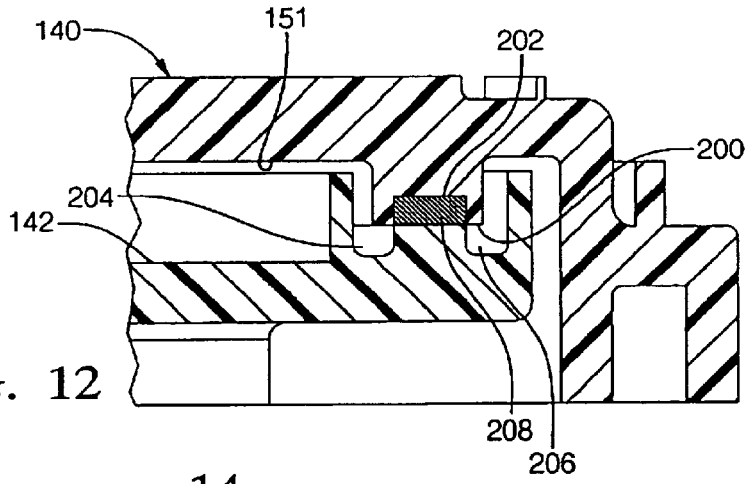
FIG. 12 is a detailed cross-sectional view taken through a first portion of the assembly shown in FIG. 3, showing fusing of the upper and lower plates along mutual mating surfaces.

Referring to FIGS. 8, 9, 11, and 12, in a currently preferred method for attaching is top plate 140 to bottom plate 142, top plate 140 is provided on its underside 151 with a continuous planar first mating surface 200 formed in a first pattern delineating the upper portions of various oil flow galleries in assembly 138. Bottom plate 142 is provided on its upper side 155 with a planar second mating surface 202 formed in a second pattern which is generally the mirror image of the first pattern. Surface 202 is bounded on either side by first and second grooves 204,206 (FIG. 12). Top plate 140 and bottom plate 142 preferably are formed of a thermoplastic polymer having a relatively high melting temperature, for example, a glass-filled poly phthalamide (PPA). The top and bottom plates are joined along mating surfaces 200,202 preferably by fusion, and preferably by vibration welding wherein the plates are urged together, at a loading of about 200–400 pounds per square inch, preferably about 300 pounds per square inch of mating surface, and are vibrated past each other, preferably at a frequency of about 120–240 Hz. Under these conditions, surfaces 200, 202 liquefy, compress, and fuse in a fusion zone 208, forming a mechanical and hermetic seal defining the oil galleries in a subassembly 205 (FIG. 11, shown with retainer 184 also attached). Polymer squeezed out of zone 208 is collected in grooves 204,206 which function as "flash traps." Preferably, zone 208 is compressed to a predetermined extent, preferably about 0.030–0.070 inch.

Subassembly 205 comprises only a top and bottom plate, formed of polymer and fusibly joined, thus eliminating the need for a separate gasket plate 44 and the patterns of internal gaskets on both sides of the gasket plate as required in prior art manifold 38 (FIG. 2). Further, forming the top and bottom plates by injection molding of polymer is instead of by casting and machining of aluminum reduces the overall weight and reduces the cost of the manifold substantially.

Figure 10:
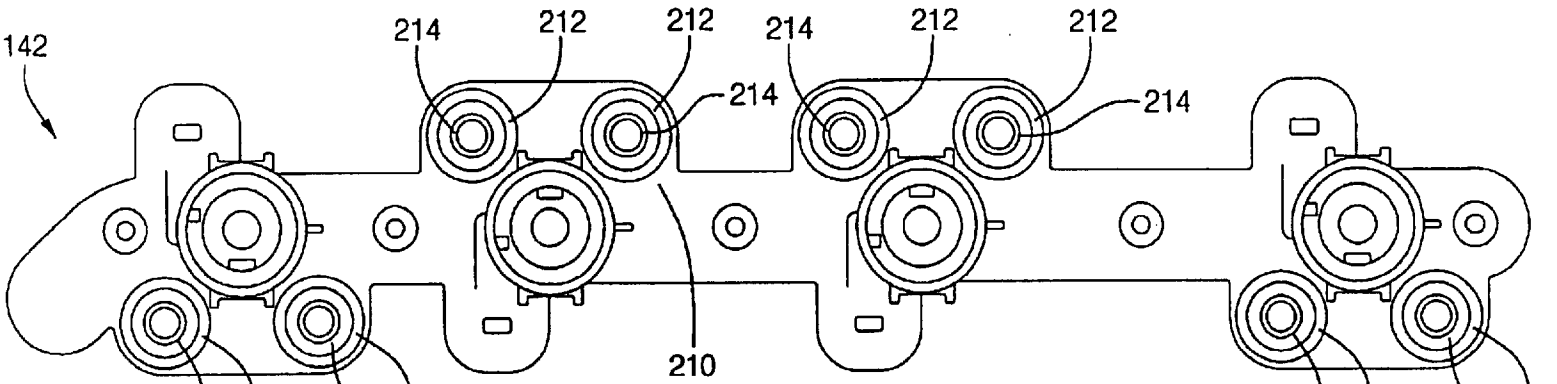
FIG. 10 is a bottom view of the lower plate in the assembly shown in FIG. 3.

Referring to FIG. 10, the underside 210 of bottom plate 142 is formed having ports 212 for receiving resilient circular oil seals 214 (also FIG. 3) for sealing to the actuating oil passages (not shown) controlled by the manifold.

Figure 6:
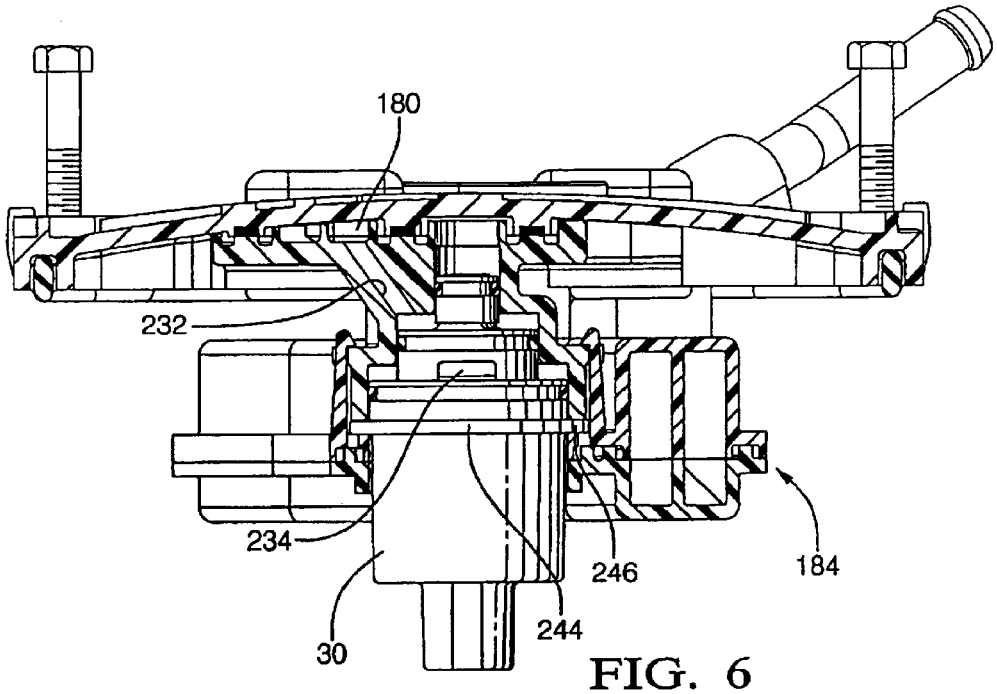
FIG. 6 is a cross-sectional view taken along line 6—6 in FIG. 4.
Figure 7:
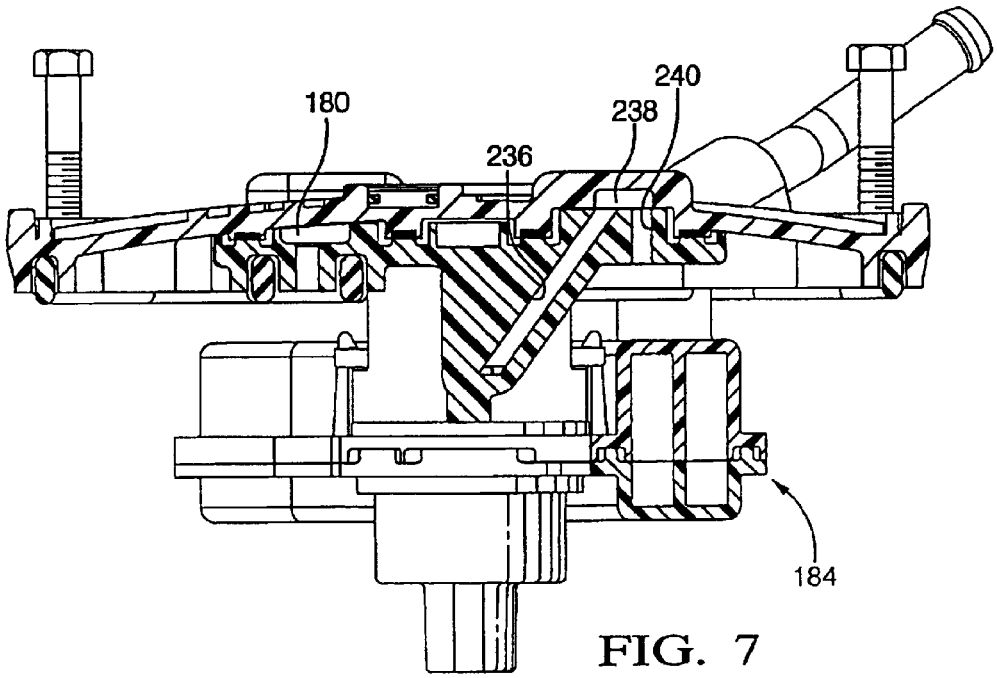
FIG. 7 is a cross-sectional view taken along line 7—7 in FIG. 4.
Figure 8:
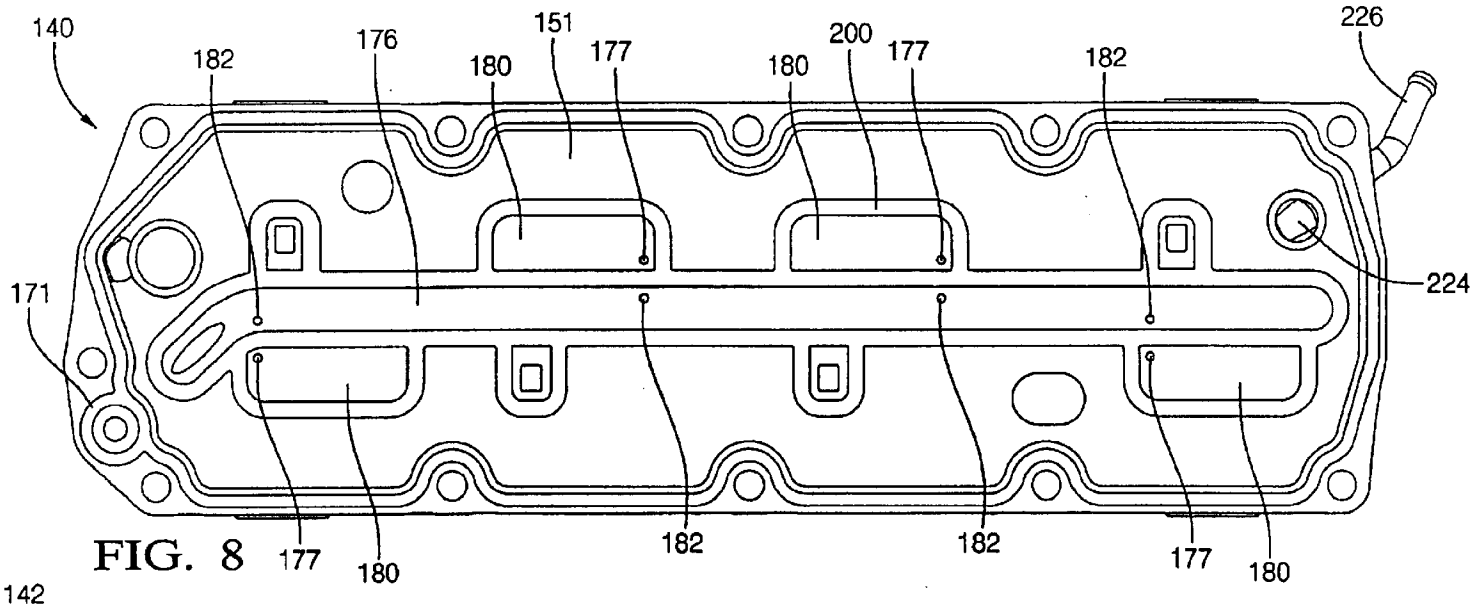
FIG. 8 is a bottom view of the upper plate in the assembly shown in FIG. 3.
Figure 9:
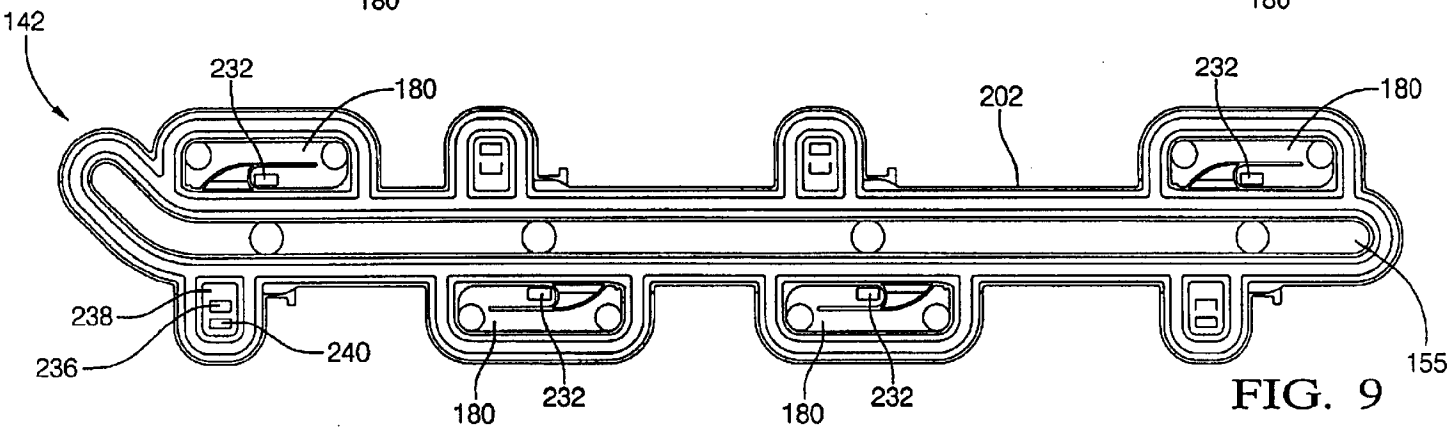
FIG. 9 is a top view of the lower plate in the assembly shown in FIG. 3.

Referring again to FIG. 3, as described above, in addition to securing solenoid valves 30 into bottom plate 142, retainer 184 may also be configured as a PCV baffle. Upper and lower elements 94,96 are preferably formed of a high-temperature thermoplastic by injection molding, similarly to top and bottom plates 140,142, and are similarly fused along planar mating surfaces by vibration welding to yield retainer 184. The resulting retainer includes a supportive bucket 216 for retaining each solenoid valve. The buckets are attached to a generally hollow sinusoidal member 218 having an entry aperture 220 and an exit fitting 222 matable with a port 224 and fitting 226 (FIGS. 3 and 8) for connection to the intake manifold (not shown) of the engine. Preferably, the interior of member 218 is provided with a series of offset walls 228 forming a labyrinthine pathway through member 218 for separation of oil droplets from air as crankcase and valve blowby is drawn through member 218 by intake manifold vacuum. Separated oil droplets agglomerate within member 218 and run back into the engine via entry aperture 220. As described above, retainer 184 is preferably provided with tabs 95 protruding upwards from upper element 94 for engaging with mating catches 97 to secure retainer 184 to bottom plate 142, thereby retaining solenoid valves 30 in proper position in sockets 172, as shown in FIGS. 5 through 7.

Figure 16:
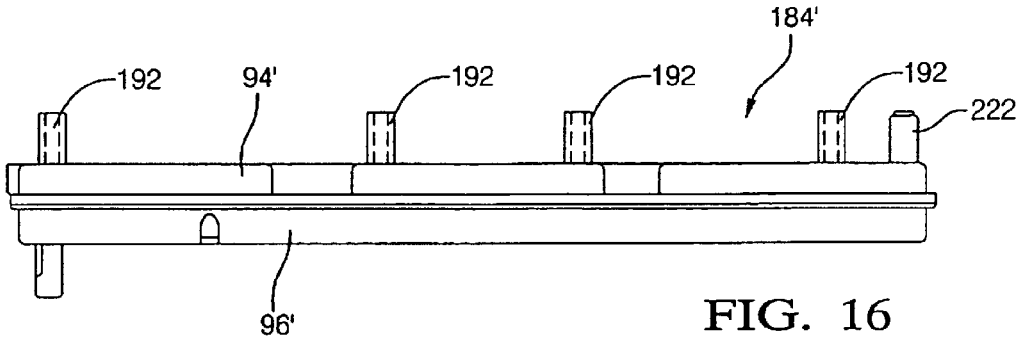
FIG. 16 is an elevational view of a second embodiment of a positive crankcase ventilation baffle for retaining solenoid valves in a LOMA in accordance with the invention.
Figure 17:
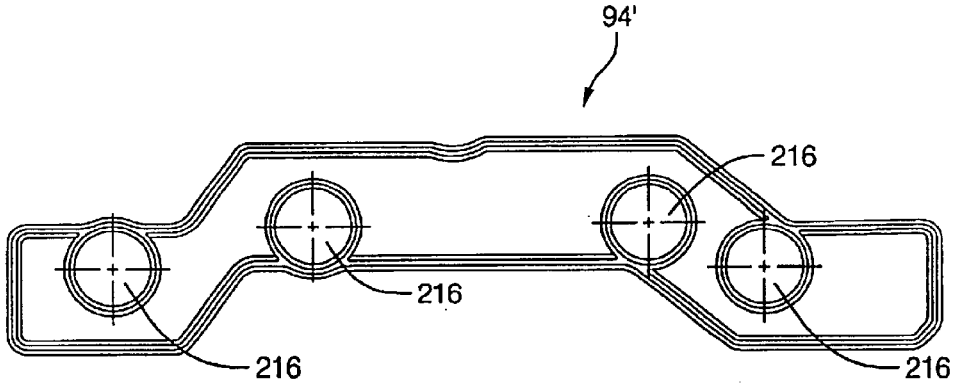
FIG. 17 is a plan view of the underside, or mating side, of the top element of the PCV baffle shown in FIG. 16.
Figure 18:
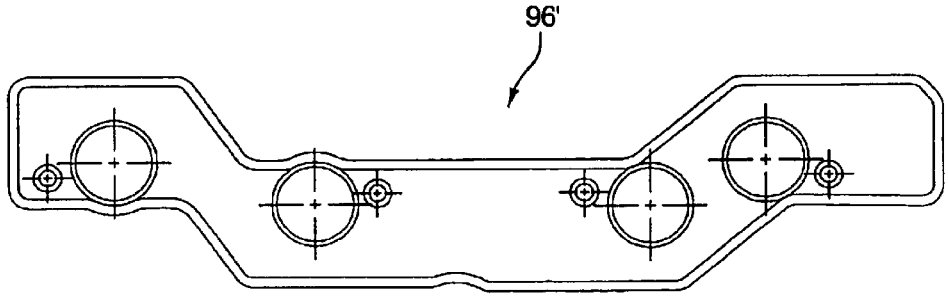
FIG. 18 is a plan view of the upper side, or mating side, of the bottom element of the PCV baffle shown in FIG. 16.

Referring to FIGS. 16 through 18, a second retainer embodiment 184' has upper and lower elements 94',96', respectively, formed and joined as in retainer 184. However, second retainer 184' is formed without tabs 95 and instead is provided with a plurality of hollow standoffs 192 formed on the upper surface of upper element 94', analogous to standoffs 92 in the prior art retainer 84, such that retainer 184' may be secured into either prior art LOMA 38 or improved LOMA 138 by bolts 46 (as in FIG. 2). Thus, PCV capability can easily be provided to prior art LOMA 38 by substitution of retainer 184' for retainer 84.

Figure 13:
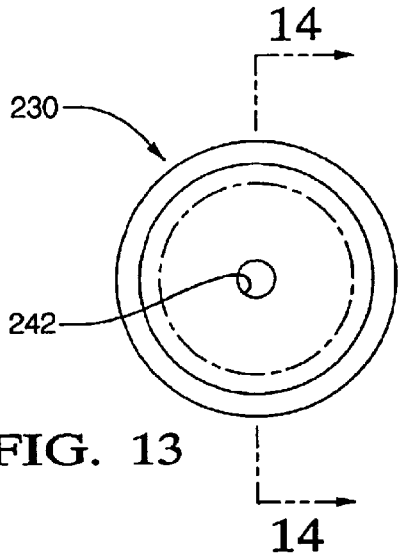
FIG. 13 is a plan view of a cup-bleed orifice for use in the manifold shown in FIG. 3.
Figure 14:
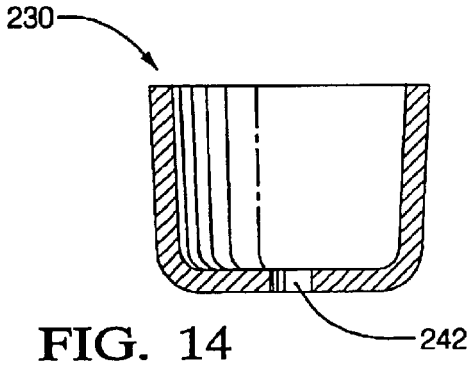
FIG. 14 is a cross-sectional view of the cup-bleed orifice shown in FIG. 13.
Figure 15:
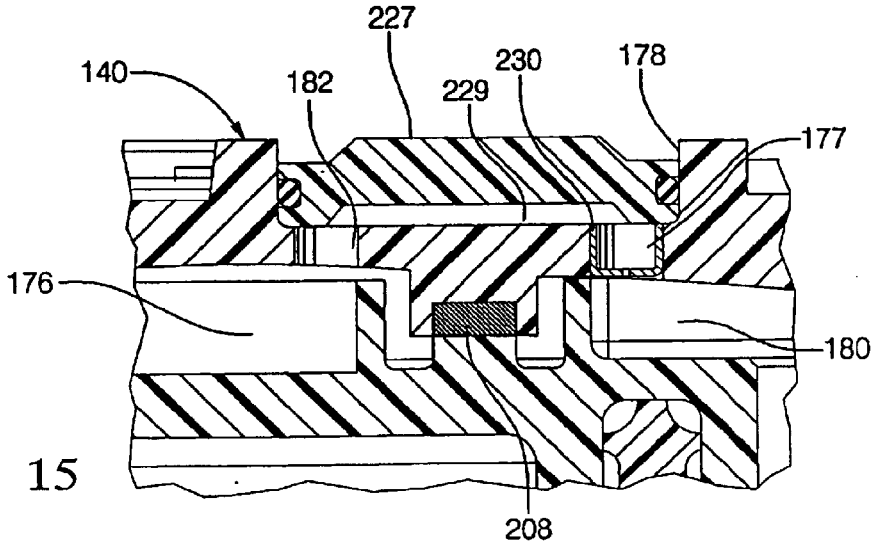
FIG. 15 is a cross-sectional view taken through a second portion of the assembly shown in FIG. 3, showing the restricted passageway for bleeding air from the oil galleries, using the cup-bleed orifice shown in FIGS. 13 and 14.

Referring again to FIGS. 3, 8, and 15, top plate 140 is provided with a riser 171 for supplying oil through a strainer 128 to global supply gallery 176. First bleed ports 182 lead upwards from gallery 176 into wells 178 formed in the upper surface of plate 140, and second bleed ports 177 lead from wells 178 into individual supply galleries 180. Each of wells 178 is closed by a gasketed plug 227 having a relieved undersurface such that a connecting passageway 229 is formed as an oil flow bridge over fusion zone 208 between first and second bleed ports 182,177. Plug 227 is retained in well 178 using known means for retaining such as press fit, staking, etc. Each of bleed ports is provided with a bleed cup 230 (FIGS. 13 and 14) formed preferably of a durable, corrosion-resistant material such as brass and pressed into the port as shown in FIG. 15.

In operation, engine oil is pumped into global supply gallery 176 displacing air through the bleed ports into the individual supply galleries 180 and thence into the engine valley via passage 232 (FIGS. 6 and 9), valve port 234, passage 236 (FIG. 7), drain chamber 238, and drain passage 240. Oil flows through this path at all times of engine operation. Preferably, the restricting orifice 242 in the bottom of cup 230 is sized at about 0.4–0.6 mm in diameter to provide for adequate flow of purging oil continuously without causing unacceptable oil pressure loss in global supply gallery 176.

In operation, improved LOMA 138 functions the same as prior art LOMA 38 and is generally interchangeable therewith.

In an alternative embodiment of an improved LOMA in accordance with the invention, if it is desirable to reduce further the size and/or weight of the assembly, retainer/baffle 184 may be eliminated as follows. Referring to FIG. 6, annular flange 244 on each solenoid valve 30 may be coated on its upper axial face with a suitable thermoplastic resin, preferably the same resin as is used to form bottom plate 142. Each valve 30 is then urged into its proper mounting location with a unit force comparable to that used for vibration welding as described above, and is spun about its longitudinal axis to cause the flange coating to melt and fuse with the mating surface 246 on bottom plate 142, thereby permanently attaching the valve to the bottom plate.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A hydraulic manifold assembly for activation and deactivation of valves in a multiple-cylinder internal combustion engine having a pressurized oil source and hydraulically-operable deactivation valve lifters, comprising:

a) a first plate having on one side thereof a first mating surface formed in a first pattern delineating first portions of various oil flow galleries in said assembly;

b) a second plate having on one side thereof a second mating surface formed in a second pattern delineating second portions of said various oil flow galleries and matable with said first surface; and c) a bonding zone including said first and second mating surfaces wherein said first and second plates are attached to each other, wherein at least one of said first and second plates is formed of a polymer and at least one solenoid valve mounted on said second plate for variably and controllably regulating flow of oil to and from predetermined ones of said deactivation valve lifters.

2. A manifold assembly in accordance with claim 1 wherein said bonding zone is a fusion zone wherein said first and second surfaces are fused together.

3. A manifold assembly in accordance with claim 2 wherein said fusion is created by vibration and pressure.

4. A manifold assembly in accordance with claim 3 wherein the frequency of said vibration is about 120 to about 240 Hz and the amplitude of said pressure is about 200 to about 400 pounds per square inch of either of said first and second mating surfaces.

5. A manifold assembly in accordance with claim 1 wherein said solenoid valves are fusibly mounted to said second plate.

6. A manifold assembly in accordance with claim 1 further comprising a retainer attached to said second plate and having a plurality of buckets for retaining said plurality of solenoid valves in operational position with respect to said second plate.

7. A manifold assembly in accordance with claim 6 wherein said retainer further comprises a plurality of tabs for attaching said retainer to said second plate.

8. A manifold assembly in accordance with claim 7 wherein said manifold assembly is free of threaded fasteners.

9. A manifold assembly in accordance with claim 7 wherein said retainer includes a first plate and a second plate which are joined as by fusing to form said retainer.

10. A manifold assembly in accordance with claim 9 wherein said retainer includes a hollow member for use as a positive crankcase ventilation baffle, said member having an entry port and an exit port and being connectable to an intake manifold of said internal combustion engine.

11. A manifold assembly in accordance with claim 10 wherein said retainer further comprises a plurality of internal walls forming a labyrinthine pathway for engine vapors.

12. A manifold assembly in accordance with claim 1 further comprising a global oil supply gallery and a plurality of individual oil supply galleries, wherein said global supply gallery is in communication with each of said individual supply galleries via a bleed passage formed in at least one of said first and second plates.

13. A manifold assembly in accordance with claim 12 wherein said bleed passage includes an oil restriction orifice.

14. A manifold assembly in accordance with claim 13 wherein said orifice has a diameter of about 0.4 to about 0.6 mm.

15. A manifold assembly in accordance with claim 1 wherein said polymer is glass-filled.

16. A manifold assembly in accordance with claim 15 wherein said glass-filled polymer is a high temperature grade.

17. A manifold assembly in accordance with claim 15 wherein said glass-filled polymer is PPA.

18. A manifold assembly in accordance with claim 1 wherein said second pattern is a mirror image of said first pattern.

* * * * *